US007889093B2

(12) United States Patent
Thomas

(10) Patent No.: US 7,889,093 B2
(45) Date of Patent: Feb. 15, 2011

(54) SYSTEM FOR SAFETY INFORMATION

(76) Inventor: Carrie P. Thomas, 1111 Gerard Ave., Apt. 1K, Bronx, NY (US) 10452

( * ) Notice: Subject to any disclaimer, the term of this patent is extended or adjusted under 35 U.S.C. 154(b) by 271 days.

(21) Appl. No.: 12/236,293

(22) Filed: Nov. 7, 2008

(65) Prior Publication Data

US 2010/0117866 A1 May 13, 2010

(51) Int. Cl.
*G08B 3/00* (2006.01)

(52) U.S. Cl. ..... 340/691.6; 340/944; 340/908.1; 340/925; 340/917; 340/933; 340/931; 340/907; 340/906

(58) Field of Classification Search ..... 340/691.6, 340/944, 908.1, 925, 917, 933, 931, 907, 340/906

See application file for complete search history.

(56) References Cited

U.S. PATENT DOCUMENTS

| | | | | |
|---|---|---|---|---|
| 6,384,742 | B1 * | 5/2002 | Harrison | 340/944 |
| 7,605,773 | B2 * | 10/2009 | Janssen | 345/7 |
| 2005/0270175 | A1 * | 12/2005 | Peddie et al. | 340/907 |
| 2005/0286972 | A1 * | 12/2005 | Gongolas | 404/9 |
| 2008/0018494 | A1 * | 1/2008 | Waite et al. | 340/907 |
| 2009/0135024 | A1 * | 5/2009 | Park et al. | 340/929 |

* cited by examiner

*Primary Examiner*—Daryl Pope
(74) *Attorney, Agent, or Firm*—Michael L. Greenberg, Esq.; Greenberg & Lieberman, LLC

(57) ABSTRACT

A system for displaying safety information—particularly for pedestrian crosswalks and vehicle brake lights—that permits an operator located at a hub to upload and transmit at least one image to select traffic signals or brake light display screen connected within the network. The at least one image depicts a display of regional, local or even neighborhood significance. The operator, or user, can pinpoint which traffic signals will ultimately display these images. The images are locally significant, informative and whimsical.

19 Claims, 3 Drawing Sheets

SYSTEM FOR SAFETY INFORMATION

FIELD OF THE INVENTION

The present invention is a system for disseminating and coordinating information for pedestrians and motorists. The present invention relates to electric traffic display signals, signs, and vehicle brake lights that are in synch with a central operating location to display various images of characters and mascot displays at specific times. The displays represent a specific safety instruction or hazard and can be modified or changed at the central operating location.

BACKGROUND OF THE PRESENT INVENTION

Traffic signals—particularly at crosswalks—are vital to the public safety and regulation of traffic flow. This is why typical crosswalk displays inform pedestrians of when to "walk" and when to "not walk." However, numerous jaywalking incidents occur despite these signals. Part of the reason is that pedestrians simply do not pay attention to the crosswalk signal. People are very desensitized to these common displays and while most people are generally careful when crossing the street, there are times for all people that they are in their own zone and not paying particular attention to their surroundings. For this reason, there is a need for a system that keeps pedestrians interested in their surroundings, particularly when crossing the street. The present invention offers a system that presents images on the crosswalk display that is catered to the local community or neighborhood and is both informative and whimsical.

Another issue with current methods of crosswalk information is that pedestrians are typically limited to two bits of information. They are told to go or not go. Current crosswalk displays are configured to display a green symbol or wording when it is time to cross, while a red symbol or wording appears when it is not time to cross. Sometimes the red symbol will blink, or numbers will count down, as the permission to cross is about to expire. But the number countdown provides the only opportunity for pedestrians to know how long they have in the street before the light ultimately will change. This aspect is uninteresting and fails to capture the attention of some absent-minded pedestrians. There continues to be a need for a system that makes crossing the street interesting and fun while also being informative. The present invention solves that need through the display of localized mascots that depict a regional or localized theme while also engaging on some sort of action or form that demonstrates to the viewer the time and opportunity to cross the street.

U.S. Pat. No. 5,654,705 issued to Van Houten et al on Sep. 6, 1997, is an apparatus for prompting pedestrians that uses an animated pictorial as an information display. Unlike the system of the present invention, Van Houten is an apparatus that merely seeks to inform pedestrians relating to the crosswalk display that is hardwired to use such limited images and sensors. The present invention, however, is linked to a network with a hub controller. In this manner, the images of the present invention can be changed as frequently as desired while also being targeted to select crosswalk displays that are connected to the network. This contrast pertaining to the present invention also applies to numerous other attempts at pedestrian flow and information.

Current systems of crosswalk displays also fail to cater the images or displays to select neighborhoods, blocks or mere street corner. While timing of the displays can be altered, there is not a mechanism to modify select locally recognizable images for select traffic signals in a quick and technician-free manner. The present invention solves this issue by permitting a user at a central location to upload at least one image into a computer that is wired into a network containing the relevant traffic and crosswalk signals. In this manner, the present invention allows this user to target specific crosswalk displays with specific images that can relate to a state/province, city, neighborhood or even block. The user can change, remove or add images as needed.

SUMMARY OF THE PRESENT INVENTION

The present invention is a system for disseminating and coordinating information for pedestrians and motorists. The present invention relates to electric traffic display signals and signs that are in synch with a central operating location to display various images of characters and mascot displays at specific times. The present invention in an additional embodiment also relates to incorporating such display images and display changeability on vehicle brake lights. The images represent a specific safety instruction or hazard and can be modified or changed at the central operating location. The images are intended to provide information with amusement and community feeling or nostalgia.

An example of the present invention could relate to a city such as Baltimore. Typically, the cross walks, railroad crossings and traffic signals across the city display the usual "cross" or "don't cross" text or red/green hand. But on days featuring home games for the Baltimore Orioles baseball team, a user at the central operating location can emit a signal to specific cross walk displays or traffic lights that display the image of an Oriole to signal that pedestrians or vehicles may go. The user at the operating location may elect to present this display only in the area of the baseball field or throughout the entire city. Moreover, if the Baltimore Orioles win the game, the user at the operating location can immediately emit a signal to the targeted traffic lights or cross walk displays to change the image to an image or even animation resembling victory. In addition, during the month when the Orioles may play at the same time as the local Ravens football team, the user at the central operating location can simultaneously emit signals to display Oriole-related mascots on certain traffic displays and also Raven-related mascots on others.

The images themselves can indicate the relevant information based on expressions or actions. For example, an image of a confused monkey with a lump on his head might be displayed at cross walk signals to represent "don't walk." Meanwhile, the image or animation of a friendly lumping monkey may be displayed to represent that it is safe to cross the street. In short, the system of the present invention permits the user at the central operating location, as well as other various operating locations in additional embodiments, to submit and ultimately display images catering to local interests that represent traditional safety or hazard information.

As mentioned above, an additional embodiment of the present invention relates to displaying such whimsical and informational images on vehicle brake lights. In the case of this additional embodiment, the driver can serve as the central operator and upload images that feed into the brake light display similar to the conventional means described above. In this manner, the driver can upload and ultimately display images customized to his or her personal tastes or those of the community. In addition, the vehicle brake lights also can receive a remote signal emitted from the central operator or hub within the municipality as described in the primary embodiment. In this manner, the vehicle brake lights will receive and ultimately display the customized image of the specific targeted area whenever the user activates the brake lights.

DETAILED DESCRIPTION OF THE PREFERRED EMBODIMENT

Figure 1:
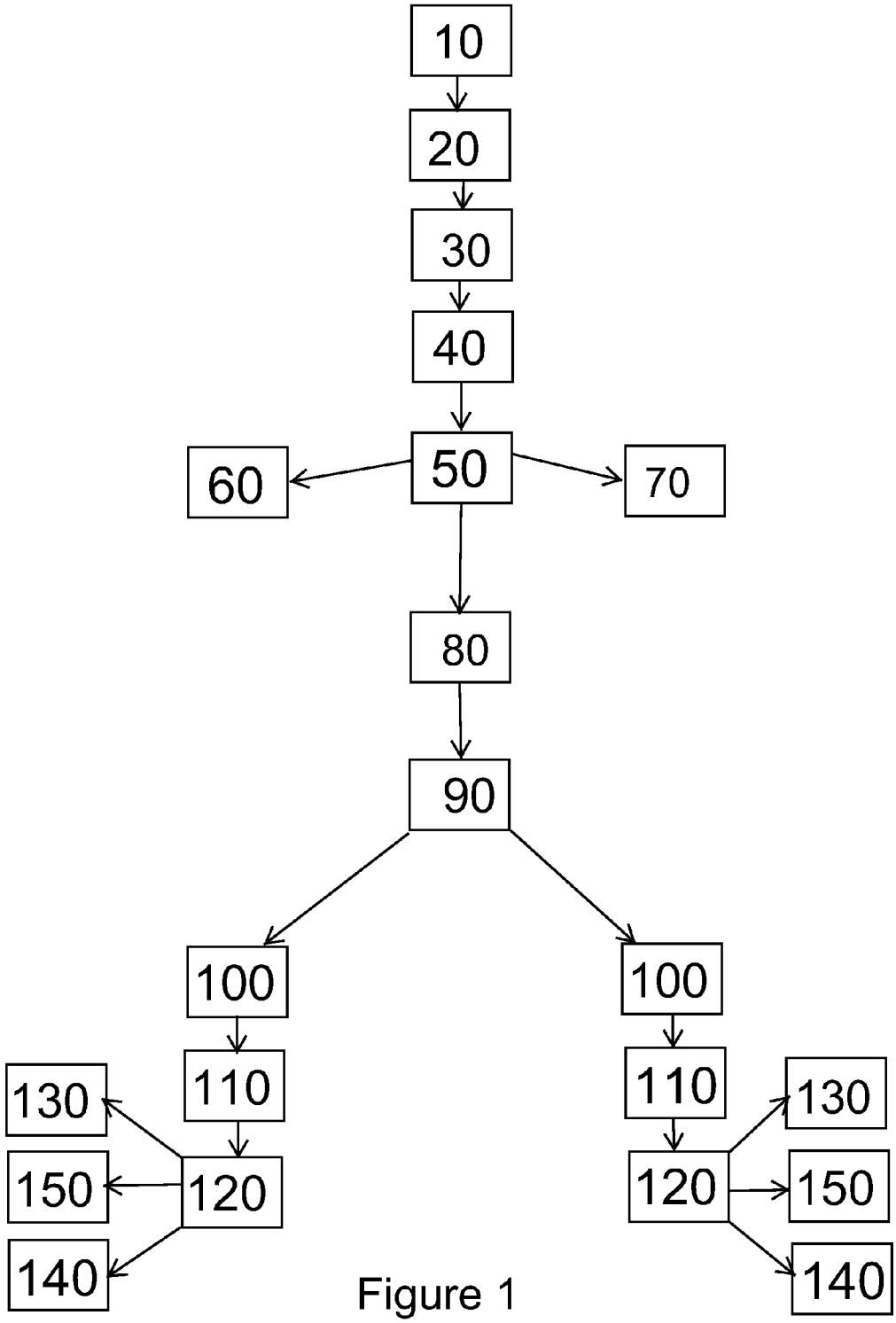
FIG. 1 is a flow chart detailing the system of the present invention.

The present invention is a system that allows for communication between a central operating location and select traffic, railroad or crosswalk displays. Images are transferred and ultimately displayed. These images are catered to the localized community in that the images are mascots or other recognizable image that most people in that particular location will recognize. FIG. 1 is a flow chart that details the steps taken to ultimately display targeted images catering to select locations that are integrated into the communications grid. First, a user moves to a central location (10). The central location serves as a hub in that the central location is integrated via conventional wired or wireless communication and data transfer between the central location and the various displays scattered throughout the network grid. The hub is also referred to as the central location. In its basic form, the central location is formed with a computer and conventional hardwire or wireless data transfer technology that is connected to a crosswalk display. The crosswalk display is equipped with conventional wired or wireless receive technology. So back at the central location, the user—or operator—will have at least one image or animation (20). For this application, the term images and at least one image are construed to mean that one image may be dealt with within the system of the present invention, and more than one image also may be used. The user will take the at least one image and upload it into the conventional data transfer program in the computer (30). The software program also will display on the computer screen a grid or map (40). The grid or map is essentially a schematic that pinpoints the locations of each traffic display. The user then may choose which traffic display screen to send the images (50) via data transfer. The user also has the option of choosing pre-selected groupings (60) or merely using a stylus or traditional mouse to create a circle over the area that is to be targeted (70).

Once the user chooses the targeted traffic displays, the user sends the signal (80). This prompts the data transfer of the image from the computer at the central location to the targeted display screens that were chosen (90). Each targeted display screen will then receive the image data (100) via conventional receiving technology. The targeted display screens will then display the image or animation (110) on the screen. Meanwhile, the standard timing mechanisms on the traffic displays will continue to calculate and inform pedestrians and motorists (120) on such items as whether or not to cross the street. The information displayed will be the images that were transferred from the central location. In the case of permission to cross the street, for example, one image will be displayed (130). When time is running down for a pedestrian to cross the street, another image, variation of the first image, or animation relating to the image may be displayed (140). When permission is not given to cross a street, another image, variation of the first and/or second image, or animation relating to the image may be displayed (150).

Figure 2:
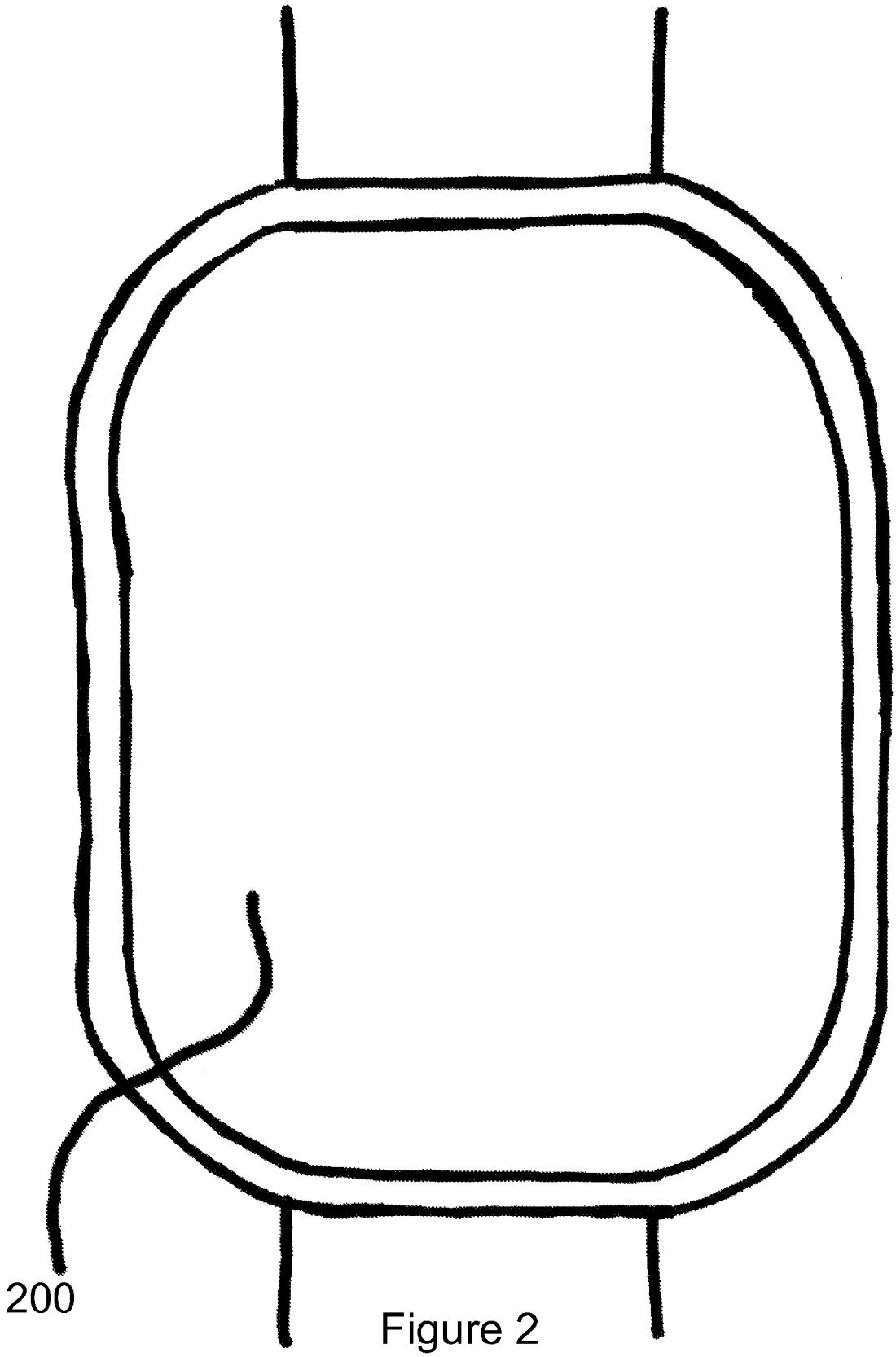
FIG. 2 is a view of a crosswalk signal of the present invention.

FIG. 2 offers an example of a crosswalk signal featuring an image. The signal for each embodiment of the present invention is formed with a display screen (200). The display screen projects or otherwise displays the images to the viewers. The system of the present invention takes into account locally significant images, or mascots, that are recognizable and catered to those within the vicinity of the display. The images representing these locally significant or sentimental mascots or symbols can be displayed in scope from throughout the network on down to merely one traffic or crosswalk signal. However, it should be noted that the present invention also employs the use of image display to indicate to the viewer additional messages. For example, an image that is both reflective of the local community and indicative of hurrying up may relate to the viewer that a particular traffic light changes colors quickly. Another more whimsical example relates to displaying a confused monkey with a lump on his head to indicate to pedestrians not to cross the street. Meanwhile, a friendly jumping monkey may be displayed indicating to pedestrians that it is safe to cross the street. Again, these images can be localized to cater to local or even neighborhood culture. For example, a bear could be used in Chicago or a bald eagle in Washington, D.C. to symbolize locally significant mascots. Holidays or special occasions can also make use of such displays.

Figure 3:
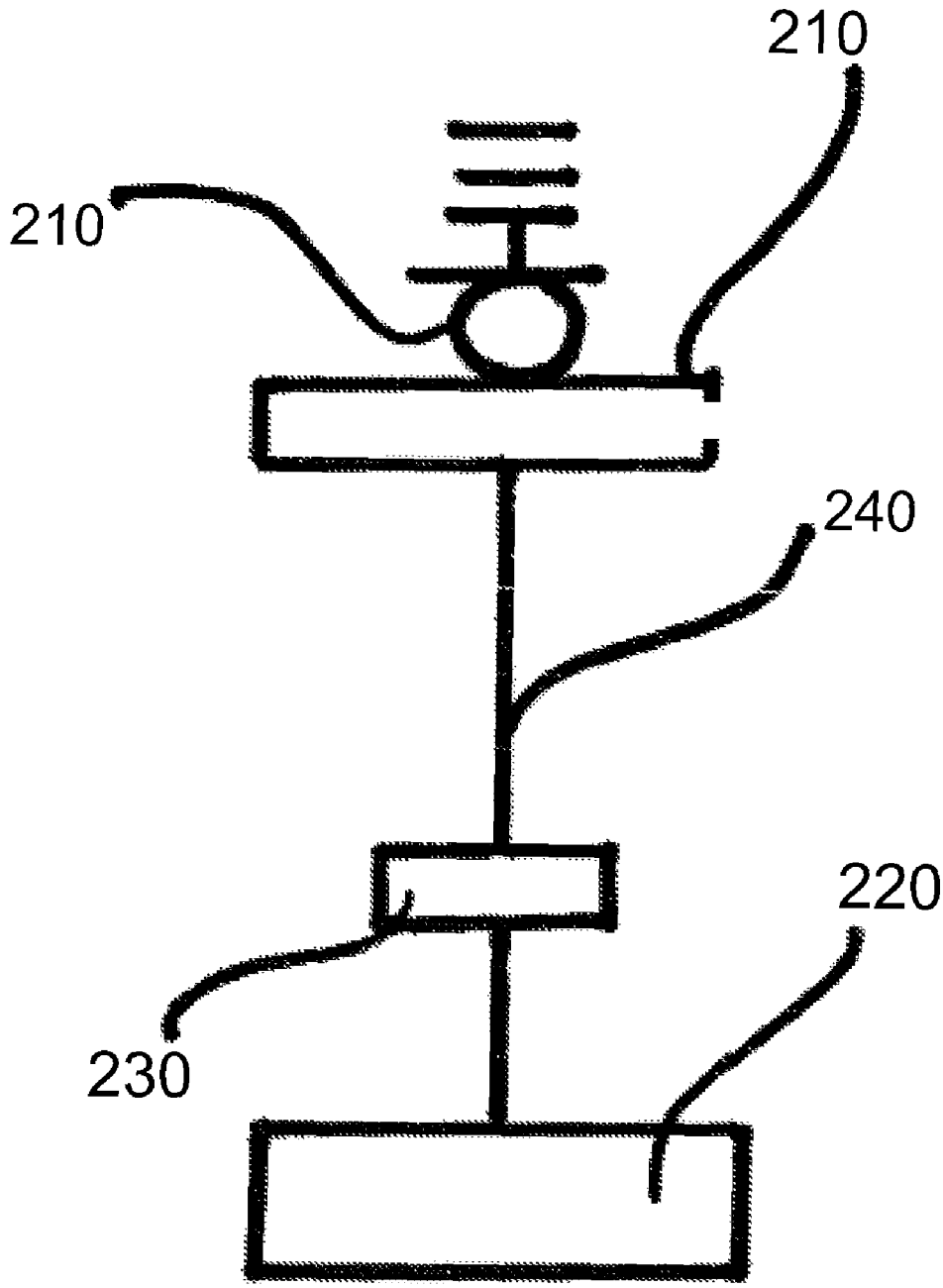
FIG. 3 is a schematic view of an embodiment of the present invention relating to a vehicle brake system displaying uploaded images upon brake light activation.

An additional embodiment of the present invention is seen in FIG. 3 and relates to displaying such whimsical and informational images on vehicle brake lights. In the case of this additional embodiment, the driver can serve as the central operator and upload images that feed into the brake light display (210) similar to the conventional means described above. In this manner, the driver can upload and ultimately display images customized to his or her personal tastes or those of the community. This also effectively permits the driver to include a changing "bumper sticker" images within the brake light system so that this "bumper sticker" image can be changed, removed and uploaded whenever the driver desires. Again, the image, text or animation is displayed on the brake light display (210) when the brake light is activated. This occurs after the driver or passenger, acting as the central operator, uploads the data of the image into the vehicle hub (220), the vehicle hub (220) located within the standard interior vehicle controls such as radio, air conditioner, MP3 outlet, etc.

In this embodiment, the vehicle hub (220) serves as a conventional computer or data reader that can receive an image uploaded via a conventional data transfer item such as a data stick or CD. The computer or data reader is connected either wired or wireless through the brake (230) and ultimately at the brake light display (210) of the vehicle. Essentially, the connection goes along with the standard connection (240) between the brake (230) and the brake lights and brake light display (210). When the brake (230) is not compressed, the circuit remains open and the brake light display (210) does not display an image. However, when the brake (230) is compressed, the connection (240) closes the circuit and the uploaded image will be displayed on the brake light display (210) of the vehicle. The brake light display (210), like the traffic display screen, is conventional and made to be conducive to displaying such images. It should be noted that the present invention involves replacing a conventional crosswalk signal with the locally significant image that is recognizable to most viewers.

In conclusion, the present invention is an information system comprising establishing a hub, such that the hub is in communication with a network grid. At least one display screen, also referred to as the display screen, is placed within the network grid, the at least one display screen equipped to receive information from the hub. At least one image, also referred to as the image, is uploaded at the hub. The operator chooses the at least one display screen to send the at least one image via a data transfer. The at least one image is sent to the at least one display screen, prompting the data transfer of the at least one image originating from the hub to go to the at least one display screen that was targeted. The at least one image at the display screen is received and the at least one image is displayed on the display screen. A presentation of the at least one image may be adapted to inform a viewer of changing external conditions. The replacing of a conventional crosswalk signal with the locally significant image that is recognizable to most viewers could also be a sports team logo or an icon that is not conventionally placed on a crosswalk signal.

The present invention is further comprised of catering the at least one image to a locally significant image that is recognizable to most viewers. This is done by pre-selecting at the hub each of the at least one display screen to receive the at least one image. Specific pre-selected groupings of the at least one display screen are targeted to receive the data transfer of the at least one image. Data from the hub is transferred to the at least one display screen, via conventional wired or wireless means and conventional wired or wireless connection. Animation also may be transferred from the hub to the at least one display screen, such that the at least one display screen displays the at least one animation at a requisite time.

An additional embodiment of the present invention relates to vehicles. In this embodiment, the present invention is an information system, comprising establishing a vehicle hub within a vehicle that falls under driver control. The vehicle hub is connected to at least one brake light, also referred to as brake lights, on the vehicle and a brake of the vehicle, the at least one brake light equipped with a display screen. At least one image is uploaded into the vehicle hub via data transfer. The at least one image is sent to the display screen of the at least one brake light. The at least one image is displayed on the brake light display screen of the at least one brake light when the driver activates the brake of the vehicle. The driver controls actions of the at least one image displayed on the brake light display by compressing or releasing pressure on the brake of the vehicle. The at least one image stored within the vehicle hub may be switched with a different at least one image. The driver will close the circuit to the at least one break light display screen when the brake is compressed.

I claim:

1. An information system, comprising:

establishing a hub, such that the hub is in communication with a network grid;

placing at least one display screen of a crosswalk signal within the network grid, the at least one display screen equipped to receive information from the hub;

uploading at least one image at the hub;

choosing which at least one display screen to send the at least one image via a data transfer;

sending the at least one image to the at least one display screen, prompting the data transfer of the at least one image originating from the hub to go to the at least one display screen that was targeted;

receiving the at least one image at the display screen;

displaying the at least one image on the display screen; and adapting a presentation of the at least one image to inform a viewer of changing external conditions.

2. The information system of claim 1, further comprising catering the at least one image to a locally significant image that is recognizable to most viewers.

3. The information system of claim 2, further comprising pre-selecting at the hub each of the at least one display screen to receive the at least one image.

4. The information system of claim 1, further comprising pre-selecting at the hub each of the at least one display screen to receive the at least one image.

5. The information system of claim 2, further comprising targeting specific pre-selected groupings of the at least one display screen to receive the data transfer of the at least one image.

6. The information system of claim 1, further comprising targeting specific pre-selected groupings of the at least one display screen to receive the data transfer of the at least one image.

7. The information system of claim 1, further comprising transferring data from the hub to the at least one display screen.

8. The information system of claim 7, further comprising transferring data from the hub to the at least one display screen via wired connection.

9. The information system of claim 7, further comprising transferring data from the hub to the at least one display screen via wireless connection.

10. The information system of claim 1, further comprising transferring data from the hub to the at least one display screen via wired connection.

11. The information system of claim 1, further comprising transferring data from the hub to the at least one display screen via wireless connection.

12. The information system of claim 1, further comprising transferring animation from the hub to the at least one display screen, such that the at least one display screen displays the at least one animation at a requisite time.

13. An information system, comprising:

establishing a vehicle hub within a vehicle that falls under driver control;

connecting the vehicle hub so that the vehicle hub is connected to at least one brake light on the vehicle and a brake of the vehicle, the at least one brake light equipped with a display screen;

uploading at least one image into the vehicle hub via data transfer;

sending the at least one image to the display screen of the at least one brake light;

displaying the at least one image on the brake light display screen of the at least one brake light when the driver activates the brake of the vehicle; and controlling actions of the at least one image displayed on the brake light display by compressing or releasing pressure on the brake of the vehicle.

14. The information system of claim 13, further comprising switching the at least one image stored within the vehicle hub with a different at least one image.

15. The information system of claim 13, further comprising switching the at least one image stored within the vehicle hub with a different at least one image.

16. The information system of claim 13, further comprising closing a circuit to the at least one break light display screen when the brake is compressed.

17. The information system of claim 2, further comprising replacing a conventional crosswalk signal with the locally significant image that is recognizable to most viewers.

18. The information system of claim 17, wherein the locally significant image that is recognizable to most viewers is a sports team logo.

19. The information system of claim 17, wherein the locally significant image that is recognizable to most viewers is an icon that is not conventionally placed on a crosswalk signal.

* * * * *